United States Patent [19]

Ericson

[11] 3,979,031

[45] Sept. 7, 1976

[54] DISCHARGE VALVE ASSEMBLY FOR A METAL LADLE ACTUATED THROUGH BOTTOM OF LADLE

[76] Inventor: John A. Ericson, 732 Market St., Youngstown, Ohio 44502

[22] Filed: May 5, 1975

[21] Appl. No.: 574,565

[52] U.S. Cl. ..... 222/592; 222/601; 251/144

[51] Int. Cl.[2] ..... B22D 35/06; B22D 41/10

[58] Field of Search ..... 222/559, 557, 597, 601, 222/592; 251/144, 368

[56] References Cited

UNITED STATES PATENTS

| | | | |
|---|---|---|---|
| 3,651,825 | 3/1972 | Sury | 222/559 X |
| 3,768,708 | 10/1973 | Domulewicz | 222/557 |
| 3,847,312 | 11/1974 | Marr et al. | 222/559 X |

FOREIGN PATENTS OR APPLICATIONS

| | | | |
|---|---|---|---|
| 386,424 | 1/1923 | Germany | 222/559 |
| 456,251 | 3/1966 | Japan | 222/559 UX |

*Primary Examiner*—Robert B. Reeves
*Assistant Examiner*—David A. Scherbel
*Attorney, Agent, or Firm*—Webster B. Harpman

[57] ABSTRACT

A discharge valve assembly for a hot metal ladle having a discharge opening in the bottom thereof includes a heat resistant stopper positioned in the ladle for movement toward and away from the discharge opening and a vertical portion extending through the bottom of the ladle for actuating the same.

5 Claims, 2 Drawing Figures

DISCHARGE VALVE ASSEMBLY FOR A METAL LADLE ACTUATED THROUGH BOTTOM OF LADLE

BACKGROUND OF THE INVENTION

1. Field of the Invention:

This invention relates to hot metal ladles and means for controlling discharge openings in the bottom thereof.

2. Description of the Prior Art:

Prior structures of this type have employed various means for moving a stopper toward and away from a discharge opening in a nozzle block. See for example my earlier U.S. patent, 3,820,693.

This invention simplifies the valve assembly and the construction thereof and provides that the several operating parts exposed to the hot metal be formed of or covered by suitable refractory material.

Summary of the Invention

A discharge valve assembly for a hot metal ladle incorporates a nozzle block having a metal discharge opening and a passageway for a stopper actuating device which is positioned for movement toward and away from the metal discharge opening so as to control the flow of metal therethrough. The stopper actuating device and stopper are assembled into a unit which is formed of or covered with a suitable refractory enabling the stopper and the device for actuating it to withstand the temperature of the molten metal.

A gasket formed of a suitable refractory such as boron-nitride and capable of withstanding the temperature of the molten metal is employed to seal the moving stopper and actuating device unit with respect to the passageway in the nozzle block through which it extends.

DESCRIPTION OF THE PREFERRED EMBODIMENT

Figure 1:
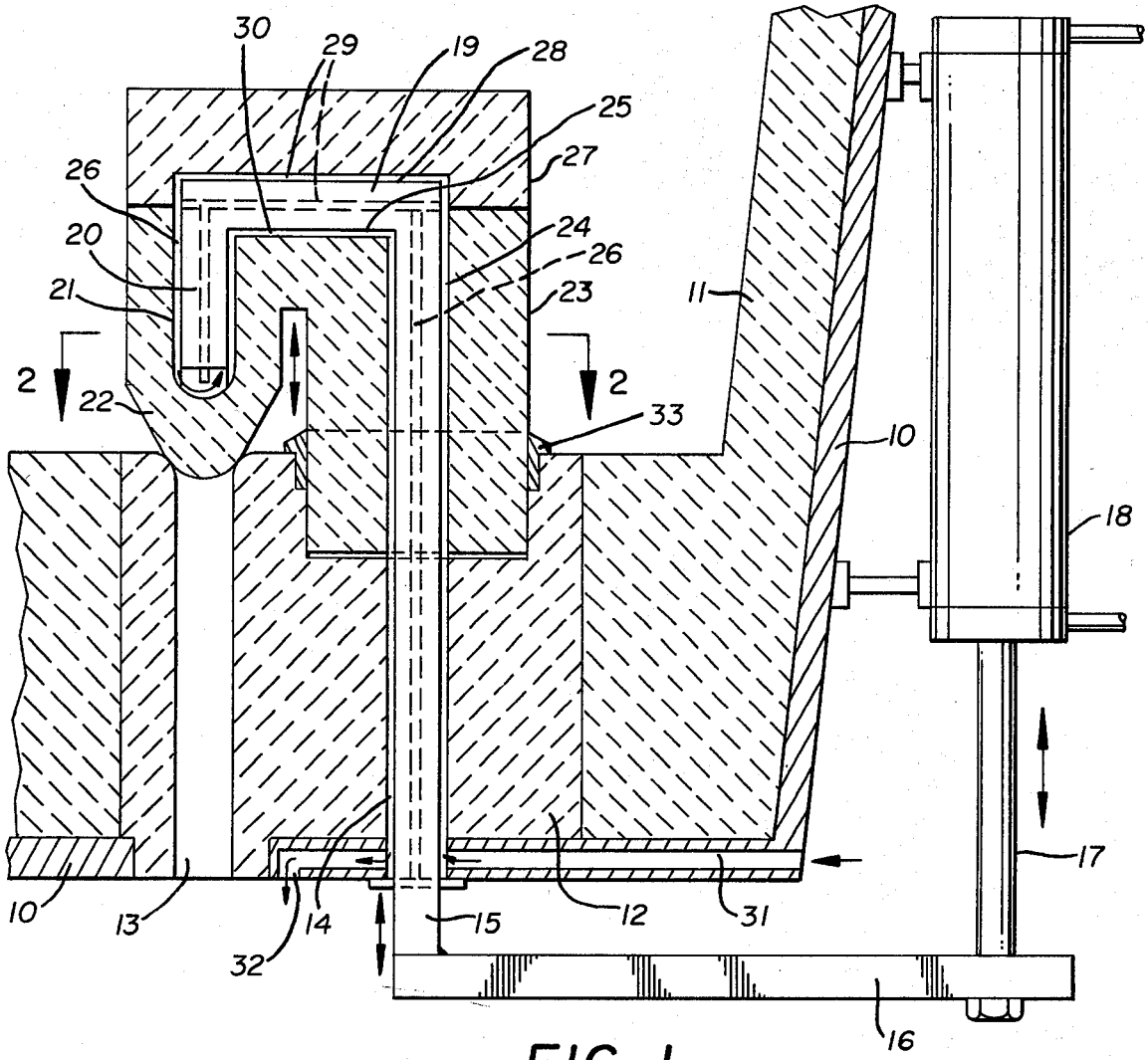
FIG. 1 is a vertical section through a portion of a ladle having the discharge valve assembly of the invention positioned therein.

In the form of the invention chosen for illustration herein, the discharge valve assembly for a hot metal ladle provides a ladle 10 with a refractory lining 11 and a modified nozzle block 12. The nozzle block 12 has a vertically positioned hot metal opening 13 and a spaced parallel passageway 14 through which a vertical portion 15 of a stopper actuating device is movably positioned.

In addition to the vertical portion 15 the stopper actuating device includes a horizontal arm 16 which extends in spaced parallel relation with the bottom of the ladle 10 to one side thereof where it is engaged by a piston rod 17 of a piston and cylinder assembly 18 so as to be movable vertically thereby. The upper end of the vertical portion 15 of the stopper actuating device has a short sideward extension 19, the outer end of which is downturned as at 20.

Figure 2:
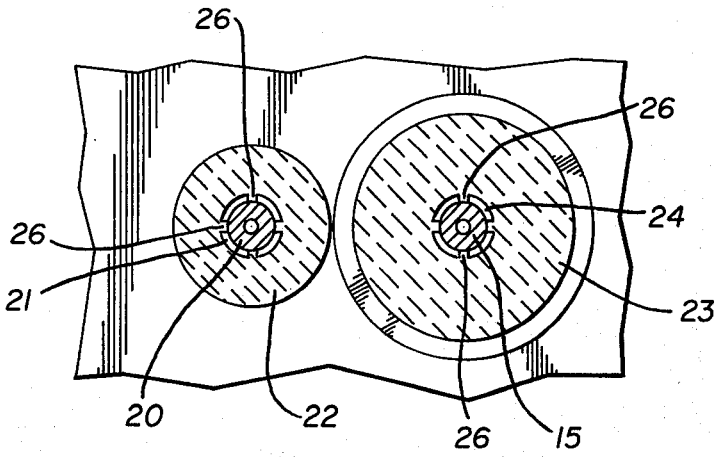
FIG. 2 is a transverse section on line 2—2 of FIG. 1.

By referring to FIG. 1 of the drawings, and the cross section of FIG. 2, it will be seen that the vertical portion 15 of the stopper actuating device is of smaller diameter than the passageway 14 in the nozzle block and that the downturned end 20 is of smaller diameter than a vertical bore 21 formed in a stopper 22 which is part of an inverted U-shaped refractory body 23.

By referring to FIG. 1 of the drawings in particular it will be seen that the inverted U-shaped refractory body 23 has a secondary vertical bore 24 which is spaced horizontally with respect to the vertical bore 21 and that it is provided with a U-shaped trough 25 extending between the bores 21 and 23. It will further be seen that both the bores 21 and 24 are provided with vertically extending continuous ribs 26 and there are several of the ribs 26 so as to effectively space the vertical portion 15 of the stopper actuating device and the downturned end 20 thereof with respect to the walls defining the bores 21 and 24 respectively.

Still referring to FIG. 1, it will be seen that the stopper actuating device includes a second refractory body 27 which is shaped for registry with the uppermost portion of the refractory body 23 heretofore described. The second refractory body 27 has an inverted U-shaped trough 28 therein terminating inwardly from the ends thereof so that it establishes communication with the upper ends of the bores 21 and 24 heretofore described. The second refractory body 27 also has ribs 29 on the walls thereof defining the inverted U-shaped trough and which ribs are matched by similarly extending ribs 30 formed on the walls defining the U-shaped trough 25 in the refractory body 23. The ribs 29 and 30 therefore space the short sideward extension 19 of the stopper actuating device. The second refractory body 27 is attached to the refractory body 23.

It will thus be seen that the several ribs formed in the refractory bodies 23 and 27 space the stopper actuating device with respect thereto and permit air introduced thereinto to circulate about the same.

Those skilled in the art will observe that means for introducing cooling air into the stopper actuating device and the stopper 22 itself can include an air delivery passageway 31 and an air venting passageway 32, both of which communicate with the passageway 14 in the nozzle block 12 which is also provided with extensions of the ribs 26 hereinbefore described so that the air will circulate through the refractory bodies 23 and 27 and into the hollow interior of the stopper 22.

In order that hot metal in the ladle 10 will not flow downwardly around the outer sides of the refractory body 23 and its depending portion engaged in an enlarged upper end of the passageway 14 in the nozzle block, a gasket or sleeve 33 is provided for slidably receiving the depending portion of the refractory body 23. The gasket or sleeve 33 is preferably formed of a refractory material such as boron-nitride and may comprise a solid section of such material or it may be formed of woven boron-nitride yarn which provides a yielding somewhat resilient seal and which is capable of withstanding the high operating temperatures associated with the molten metal in the ladle and controlled by the device of the invention.

Those skilled in the art will observe that modifications in the construction hereinbefore described are possible and one such modification is the formation of the stopper 22 and the stopper actuating device of a refractory material having the necessary heat resistant qualities and suitable tensile strength for efficient performance. One such suitable refractory material is a nitride bonded silicon carbon. This material can also be used in place of a conventional refractory in the formation of the nozzle block 12 and a further variation may be made in the formation of the nozzle block 12 with a separate replaceable insert defining the hot metal opening 13 therethrough.

The above described structure provides an unusually efficient discharge valve assembly for a hot metal ladle.

Although but one embodiment of the present invention has been illustrated and described, it will be apparent to those skilled in the art that various changes and modifications may be made therein without departing from the spirit of the invention and having thus described my invention what I claim is:

1. In a ladle for molten metal having a bottom wall and means in the bottom wall providing a discharge opening and a separate passageway therethrough, a valve assembly for said discharge opening and consisting of a stopper in said ladle and means positioning said stopper for vertical movement toward and away from said discharge opening, said means including a vertical portion extending through said passageway and having a sideward extension carrying said stopper in depending relation thereto and means exteriorly of said ladle for moving said vertical portion of the means positioning said stopper and a sleeve disposed in said separate passageway for sliding sealing engagement with said vertical portion of the means positioning said stopper.

2. The ladle and valve assembly of claim 1 wherein said means providing said discharge opening and separate passageway is a nozzle block having spaced parallel openings therethrough.

3. The ladle and valve assembly of claim 1 and wherein at least said vertical portion and sideward extensions of said means positioning said stopper are metal enclosed in refractory material.

4. The ladle and valve assembly of claim 1 and wherein said stopper consists of an inverted U-shaped heat resistant body having passageways in its parallel portions and a second heat resistant body positioned thereon and attached thereto, opposed registering horizontal troughs in said bodies communicating with said passageways to provide an inverted U-shaped area for the reception of some of said stopper positioning means when said bodies are assembled thereon.

5. The ladle and valve assembly of claim 4 and wherein longitudinally extending ribs are formed on the walls of said bodies defining said passageways and troughs so as to form air circulation channels around said stopper positioning means therein.

* * * * *